US005597507A

United States Patent [19]

Garrett et al.

[11] Patent Number: 5,597,507

[45] Date of Patent: Jan. 28, 1997

[54] MICROEMULSION DETERGENT COMPOSITION CONTAINING SPECIFIC ETHOXYLATED ALCOHOL BASED SURFACTANT SYSTEM

[75] Inventors: Peter R. Garrett, Mold; Dennis Giles, Wirral, both of United Kingdom

[73] Assignee: Lever Brothers Company, Division of Conopco, Inc., New York, N.Y.

[21] Appl. No.: 412,440

[22] Filed: Mar. 29, 1995

[30] Foreign Application Priority Data

Mar. 31, 1994 [GB] United Kingdom ..... 9406524
Jul. 15, 1994 [GB] United Kingdom ..... 9414333

[51] Int. Cl.[6] ..... C11D 3/06; C11D 3/37; C11D 3/43; C11D 17/00

[52] U.S. Cl. ..... 510/340; 510/342

[58] Field of Search ..... 252/174.21, 174.22, 252/DIG. 1, DIG. 14, 174, 173, 162, 170, 135, 174.23, 174.24, DIG. 2, DIG. 19, 171, 139

[56] References Cited

U.S. PATENT DOCUMENTS

| | | | |
|---|---|---|---|
| 3,983,078 | 9/1976 | Collins | 252/540 |
| 4,489,455 | 12/1984 | Spendel | 8/158 |
| 4,561,991 | 12/1985 | Herbots et al. | 252/118 |
| 4,909,962 | 3/1990 | Clarke | 252/547 |
| 4,968,443 | 11/1990 | Lambert et al. | 252/8.8 |
| 5,035,826 | 7/1991 | Durbut et al. | 252/121 |
| 5,096,612 | 3/1992 | Pintér et al. | 252/299.01 |
| 5,158,710 | 10/1992 | Van Eenam | 252/539 |
| 5,213,624 | 5/1993 | Williams | 134/40 |
| 5,292,446 | 3/1994 | Painter et al. | 252/99 |
| 5,298,082 | 3/1994 | Weitz | 134/40 |
| 5,401,326 | 3/1995 | Mihelic et al. | 134/40 |

FOREIGN PATENT DOCUMENTS

| | | |
|---|---|---|
| 137616 | 4/1985 | European Pat. Off. . |
| 164467 | 12/1985 | European Pat. Off. . |
| 620270A | 10/1994 | European Pat. Off. . |
| 2187199 | 9/1987 | United Kingdom . |
| 2194547 | 3/1988 | United Kingdom . |
| 2247894 | 3/1992 | United Kingdom . |
| 9323444 | 11/1993 | WIPO . |
| 94/11487 | 5/1994 | WIPO . |

OTHER PUBLICATIONS

"*Evaluation of Textile Detergent Efficiency of Microemulsions in Systems of Water, Nonionic Surfactant and Hydrocarbon at Low Temperature*", J. Dispersion Science and Technology, 6(5), 523–537 (1985), Marcel Dekker Inc., C. Soland, J. Garcia Dominguez and W. E. Friberg.

GB 9406460.7 Search Report, Sep. 26, 1994.

GB 9406524.0 Search Report, Aug. 15, 1994.

*Primary Examiner*—Ardith Hertzog
*Attorney, Agent, or Firm*—A. Kate Huffman

[57] ABSTRACT

A detergent composition suitable for washing fabrics is in the form of a stable oil-in-water microemulsion and comprises an organic surfactant system, preferably wholly or predominantly consisting of ethoxylated nonionic surfactant having an average alkyl chain length of less than $C_{12}$ and containing a high proportion of $C_{10}$ material, a non-aqueous solvent, and optionally a water-soluble detergency builder, preferably polymeric. The composition can be used both for pre-wash treatment and as a main wash detergent.

8 Claims, No Drawings

MICROEMULSION DETERGENT COMPOSITION CONTAINING SPECIFIC ETHOXYLATED ALCOHOL BASED SURFACTANT SYSTEM

TECHNICAL FIELD

The present invention relates to detergent compositions containing a surfactant and a solvent in the form of an oil-in-water microemulsion.

BACKGROUND AND PRIOR ART

Liquid detergent and cleaning compositions in the form of microemulsions, both oil-in-water and water-in-oil, have been disclosed in the prior art.

EP 137 616A (Procter & Gamble) discloses liquid detergent compositions prepared from conventional detersive surfactants and other conventional detergent ingredients, plus a grease-cutting solvent. The compositions contain fatty acids or soaps (5–50 wt %) as detergency builders and are formulated as stable oil-in-water microemulsions. The preferred surfactant systems comprise sulphonate or sulphate type anionic surfactants with minor amounts of ethoxylated nonionic surfactants such as $C_{14-15}$ alcohol ethoxylates (7EO). Detergency builders may be present in amounts of 0.5–15 wt %, citrates being preferred.

EP 164 467A (Procter & Gamble) discloses laundry detergents and hard surface cleaners comprising oil-in-water microemulsions, containing alkylbenzene and olefin solvents, plus surfactants and substantial amounts of fatty acid soap. The compositions may contain ethoxylated nonionic surfactants, for example, $C_{14-15}$ alcohol ethoxylate (7EO). Compositions containing sodium citrate as builder are disclosed.

In "Evaluation of Textile Detergent Efficiency of Microemulsions in Systems of Water, Nonionic Surfactant and Hydrocarbon at Low Temperature", *J Dispersion Science and Technology,* 6(5), 523–537 (1985), Marcel Dekker Inc, C Solans, J Garcia Dominguez and S E Friberg describe the use of such microemulsions for washing under conditions of minimum mechanical energy and at low temperatures. The systems studied contain $C_{12}$ alkyl ethoxylate (4EO) nonionic surfactant, water and hexadecane, and optionally small amounts of cosurfactant (sodium dodecyl sulphate), or electrolyte (sodium tripolyphosphate or sodium citrate).

GB 2 194 547A (Colgate-Palmolive) discloses a clear single-phase liquid pre-spotting composition in the form of a microemulsion (oil-in-water or water-in-oil), solution or gel, comprising 10–70 wt % alkane (solvent), 4–60 wt % nonionic surfactant, optional cosurfactants and/or cosolvents, and 1–80 wt % water. It is suggested that builders such as sodium sesquicarbonate might be included, preferably at levels of 5 wt % and above. Unbuilt water-in-oil microemulsions are specifically disclosed which contain mixtures of the short-chain nonionic surfactant Neodol 91-6 in conjunction with the a longer-chain ($C_{14-15}$) ethoxylated nonionic surfactant.

DEFINITION OF THE INVENTION

The present invention is concerned with fabric washing detergent compositions comprising:

(i) from 2 to 40 wt % of an organic surfactant system, (ii) from 0.5 to 55 wt % of non-aqueous solvent, (iii) optionally from 0.1 to 5 wt % of water-soluble detergency builder, (iv) water and optional minor ingredients to 100 wt %, wherein the surfactant system (i) and the non-aqueous solvent (ii) together with water form a stable oil-in-water microemulsion.

According to a first aspect of the invention, the organic surfactant system comprises:

(a) 50–100 wt % of ethoxylated alcohol nonionic surfactant having an average alkyl chain length of less than $C_{12}$ and a content of $C_{10}$ material (based on the alcohol) of at least 45 wt %, and (b) optionally up to 50 wt % of co-surfactant other than ethoxylated alcohol nonionic surfactant.

According to a second aspect, a water-soluble builder (iii) which is a polymeric detergency builder is present.

DETAILED DESCRIPTION OF THE INVENTION

The present inventors have now discovered that detergent compositions in oil-in-water microemulsion form, formulated with specific nonionic surfactants having short alkyl chains and/or containing polymeric detergency builders, are capable of sufficiently rapid cleaning and stain removal to render them useful as pretreatment products as well as main wash products. Rapidity of cleaning effect is of critical importance for a pretreatment product which is required to work within a short time period.

The present invention enables detergent compositions to be formulated which are highly effective main wash products and yet which also offer a potent pretreatment facility.

The compositions are also suitable for use in machine washing employing automatic dosing systems, for example, as described and claimed in U.S. Pat. No. 4,489,455 (Procter & Gamble). This patent describes and claims apparatus and process for washing textiles based on utilising strictly limited or controlled quantities of an aqueous wash liquor, ranging from (at least) just enough to be distributed evenly and completely over the whole wash load, to (at most) about five times the dry weight of the washload.

In the compositions of the invention, which are preferably liquid, the surfactant system and the solvent are so chosen, and are present in amounts such that, together with water, they form a stable oil-in-water microemulsion in which the solvent is within the micelles of the surfactant.

The surfactant system

Preferred compositions in accordance with the invention contain a surfactant system which consists to an extent of at least 50 wt % of ethoxylated nonionic surfactant. Other surfactant types may be present in amounts of less than 50 wt % of the total surfactant system.

Thus the preferred surfactant system comprises (a) 50–100 wt % of ethoxylated alcohol nonionic surfactant having an average alkyl chain length of less than $C_{12}$ and a content of $C_{10}$ material (based on the alcohol) of at least 45 wt %, and (b) optionally up to 50 wt % of co-surfactant other than ethoxylated alcohol nonionic surfactant.

Thus, the ethoxylated nonionic surfactant preferably has an average alkyl chain length which is less than 12 carbon atoms. More preferably the average alkyl chain length is within the range of from 9 to 11 carbon atoms, and most preferably the average alkyl chain length is about $C_{10}$.

It is also highly preferred that the ethoxylated nonionic surfactant should also have a high content of $C_{10}$ material: preferably at least 45 wt %, more preferably at least 50 wt % and most preferably at least 70 wt % (all based on the alcohol). The remainder of the ethoxylated nonionic surfactant may be of predominantly shorter or longer chain length, but advantageously the total content of $C_{10}$ and shorter-chain material is at least 60 wt %, and more preferably at least 75 wt % (all based on the alcohol).

Suitable materials are the Novel (Trade Mark) 1012 series ex Vista, which are narrow-range-ethoxylated materials consisting mainly of $C_{10}$ chains, available in various average degrees of ethoxylation. The chain length distribution of these materials (based on the alcohol) is typically $C_{10}$ 84±4%, $C_{12}$ 8.5±2%, $C_{14}$ 6.5±2%.

A class of broader-range-ethoxylated materials suitable for use in the invention is the Dobanol (Trade Mark) 91 series ex Shell, which consist mainly of $C_9$, $C_{10}$ and $C_{11}$ chains. The chain length distribution of these materials (based on the alcohol) is typically $C_9$ 18%, $C_{10}$ 50%, $C_{11}$ 32%.

Other short chain nonionic surfactants are described in detail in WO 94 11487A (Unilever). These include the Lialet (Trade Mark) 91 series ex Enichem, the Synperonic (Trade Mark) 91 series ex ICI, and a $C_{10}$ Inbentin (Trade Mark) material ex Kolb.

Commercial ethoxylated nonionic surfactants are generally mixtures containing a spread of chain lengths about an average value. If desired, a mixture of two or more commercial materials may be used: preferred mixtures will give an overall average chain length of less than $C_{12}$ will also preferably provide at least 45 wt % (based on the alcohol) of $C_{10}$ material, and more preferably at least 60 wt % (based on the alcohol) of $C_{10}$ and shorter-chain material.

However, the use of longer-chain nonionic surfactants, for example, ethoxylated $C_{12-15}$ alcohols, is also within the scope of the invention.

Whatever the chain length, the HLB (hydrophilic-lipophilic balance) value of the ethoxylated nonionic surfactant suitably ranges from 8 to14, preferably from 8 to 12.5, and more preferably from 9 to 10, in order to give optimum oily soil detergency. In the shorter-chain materials preferably used, these HLB values correspond to average degrees of ethoxylation of from 2 to 8, and preferably from 2 to 6.

If desired, a co-surfactant which is not an ethoxylated alcohol may be present, although as previously indicated it is preferred that at least 50 wt % of the surfactant system be constituted by ethoxylated nonionic surfactant.

The co-surfactant may be, for example, a nonionic surfactant other than an ethoxylated alcohol, or an anionic sulphate or sulphonate type detergent, such as alkylbenzene sulphonate or primary alcohol sulphate. It is generally preferred that the surfactant system should contain not more than 40 wt % of anionic surfactant.

The surfactant system as a whole constitutes from 2 to 40 wt % of the composition, preferably from 5 to 40 wt %, more preferably from 5 to 30 wt %, advantageously from 5 to 25 wt % of the composition.

The non-aqueous solvent

The non-aqueous solvent, which constitutes from 0.5 to 55 wt %, preferably from 0.5 to 20 wt %, of the composition, may be any solvent valuable in the removal of oily soil which exhibits a sufficiently low interfacial tension towards the surfactant to form a stable oil-in-water microemulsion.

The solvent may range from wholly non-polar paraffinic materials, for example, alkanes, to more polar materials such as esters. Preferred solvents are $C_{12-16}$ alkanes, for example, dodecane, tetradecane and hexadecane, hexadecane being especially preferred.

When the solvent is an alkane, the optimum amount present depends on the chain length. For hexadecane, from 1 to 20 wt %, preferably from 5 to 15 wt % and more preferably from 7.5 to 15 wt %, is suitable.

For tetradecane, 15 to 30 wt % is preferred, and for dodecane, 25 to 55 wt % is preferred.

The weight ratio of non-aqueous solvent (alkane) to ethoxylated nonionic surfactant is also dependent on chain length. For hexadecane, it lies suitably within the range of from 0.5:1 to 2:1, and is advantageously about 1:1.

The detergency builder

It has been found that the detergency of the microemulsion system, as compared to the detergency of the same amount of surfactant alone, may be significantly increased if there is also present a detergency builder. The amount of builder that can be incorporated without destabilising the microemulsion is not, however, unlimited. Suitably, a builder may be present in an amount of from 0.1 to 5 wt %, preferably from 0.2 to 3 wt %. However, unbuilt compositions are also within the scope of the invention.

Suitable detergency builders include inorganic builders, for example, sodium tripolyphosphate, and organic builders, for example, sodium citrate.

However, the elimination of phosphates from detergent compositions has been seen increasingly as environmentally desirable, and citrates, although environmentally impeccable, are not very efficient builders.

Accordingly, preferred builders for use in the present invention are polymeric polycarboxylate builders, for example, acrylic, maleic and iraconic acid polymers. Polymers that may be used include polyacrylates, acrylic/maleic copolymers such as Sokalan (Trade Mark) CP5 and CP7 ex BASF, and the polyvinyl acetate/polyitaconic acid polymers described and claimed in WO 93 23444A (Unilever). These polymers are highly weight-effective builders which can be used in amounts that give significant building without destabilising the microemulsion.

Also suitable are nitrogen-containing monomeric polycarboxylates, for example, nitrilotriacetates and ethylenediamine tetraacetates.

The invention is further illustrated by the following non-limiting Examples, in which parts and percentages are by weight unless otherwise stated.

EXAMPLES

Detergency assessment

Oily soil detergencies were assessed by measuring the percentage removal of radio-labelled model soils by means of a scintillation counter.

Soiled cloths (5 cm×5 cm squares of knitted polyester) carrying a mixture of radiolabelled triolein and radiolabelled palmitic acid were prepared as follows. Each cloth was soaked in 0.18 ml of a toluene solution containing 3.33 g 95% triolein (radiolabelled) and 1.67 g 99% palmitic acid (radiolabelled) per 100 ml. The cloths were than allowed to equilibrate for 3 hours.

Each composition under test was applied to a fabric square at ambient temperature at a level designed to give a liquor to cloth ratio of 1:1. The contact time was varied from 5 to 30 minutes to examine kinetic effects. The cloth was then transferred, using tweezers, to an open bottle containing 15 ml of water (20° French hard) held within a shaker bath maintained at 25° C. The cloth was then rinsed for 2 minutes at a 100 rpm setting of the shaker bath (this gave a gentle to and fro motion to the rinse liquor within the bottle).

After rinsing the liquor was sampled with an automatic pipette (3×1 ml aliquots). These aliquots were transferred to plastic vials and were then mixed with 10 ml quantities of scintillator solution prior to being counted on a liquid scintillation counter. The counts (disintegrations per minute, "DPMs") were used to calculate the percentage removal for each soil component under each condition examined. Standards were taken during the initial soiling procedure to give an average figure for the DPMs added in 0.18 ml of soiling solution.

Compositions

Liquid detergent compositions were prepared to the formulations (in parts by weight) given in the tables that follow. The compositions of Examples 1 to 8 and Comparative Examples B and E containing a solvent (hexadecane) were in microemulsion form, while the compositions of the remaining Comparative Examples, which did not contain a solvent, were not. The ingredients used may be identified as follows:

[1]Novel (Trade Mark) 1012-52 ex Vista Chemicals: chain length distribution as described previously, 4EO.

[2]Dobanol (Trade Mark) 91-2.5 ex Shell: chain length distribution as described previously, 2.5EO.

These two nonionic surfactants were used together in a weight ratio of 3:1. The combined nonionic surfactant contained about 75 wt % (based on the alcohol) of $C_{10}$ material, and about 80 wt % (based on the alcohol) of $C_{10}$ and shorter-chain material. The HLB value was about 9.5.

[3]Novel (Trade Mark) 1412-4.4EO ex Vista Chemicals: $C_{12-14}$, 4.4EO.

[4]Sodium tripolyphosphate.

[5]Ethylenediamine retracetic acid, tetrasodium salt.

[6]Copolymer of maleic and acrylic acids, sodium salt: Sokalan ( Trade Mark ) CP5 ex BASF.

[7]Copolymer of polyvinyl acetate and itaconic acid, sodium salt, as described and claimed in WO 93 23444A (Unilever).

Example 1, Comparative Examples A to C: no builder

| Example | 1 | A | B | C |
|---|---|---|---|---|
| Nonionic: | | | | |
| $C_{10}EO_4$[1] | 7.5 | 7.5 | — | — |
| $C_{9-11}EO_{2.5}$[2] | 2.5 | 2.5 | — | — |
| $C_{12-14}EO_{4.4}$[3] | — | — | 10.0 | 10.0 |
| Hexadecane | 10.0 | — | 10.0 | — |
| Water (20° FH.) | 80.0 | 90.0 | 80.0 | 90.0 |
| | 100.0 | 100.0 | 100.0 | 100.0 |

The soil removal results for Examples 1 and A containing short-chain nonionic surfactant were as follows:

| Soak/contact time | Soil removal (%) | | | |
|---|---|---|---|---|
| | Triolein | | Palmitic acid | |
| (minutes) | 1 | A | 1 | A |
| 5 | 32.0 | 9.8 | 28.7 | 21.2 |
| 10 | 34.6 | 11.9 | 32.6 | 25.4 |
| 15 | 33.7 | 15.0 | 30.3 | 31.6 |
| 20 | 33.8 | 15.1 | 31.4 | 30.4 |
| 30 | 26.9 | 14.4 | 25.6 | 39.6 |

These results show that, in the absence of builder, in the removal of triolein the microemulsion gave substantially better soil removal throughout the 30-minute test period. The microemulsion also offered a significant kinetic advantage over the non-microemulsion system. With palmitic acid, the advantage was kinetic only.

The corresponding results for Comparative Examples B and C using longer-chain nonionic surfactant were as follows:

| Soak/contact time | Soil removal (%) | | | |
|---|---|---|---|---|
| | Triolein | | Palmitic acid | |
| (minutes) | B | C | B | C |
| 5 | 9.4 | 9.4 | 29.2 | 14.2 |
| 10 | 14.6 | 9.5 | 33.1 | 15.2 |
| 15 | 19.7 | 11.3 | 34.4 | 20.5 |
| 20 | 25.5 | 13.6 | 37.3 | 23.5 |
| 30 | 31.9 | 17.0 | 37.8 | 29.4 |

On triolein, the microemulsion system B finally gave results comparable with those obtained from microemulsion system 1, but required the full 30 minutes to do so; the use of short-chain nonionic surfactant clearly gives a significant kinetic advantage. The non-microemulsion system C was poor, comparable to the non-microemulsion system A.

On palmitic acid, however, the longer-chain nonionic surfactant apparently benefited more than the shorter-chain material from microemulsification.

Example 2, Comparative Examples D, E and F: sodium tripolyphosphate builder

| Example | 2 | D | E | F |
|---|---|---|---|---|
| Nonionic: | | | | |
| $C_{10}EO_4$[1] | 7.5 | 7.5 | — | — |
| $C_{9-11}EO_{2.5}$[2] | 2.5 | 2.5 | — | — |
| $C_{12-14}EO_{4.4}$[3] | — | — | 10.0 | 10.0 |
| Hexadecane | 10.0 | — | 10.0 | — |
| STP[4] | 0.8 | 0.9 | 0.8 | 0.9 |
| Water (20° FH.) | 80.0 | 90.0 | 80.0 | 90.0 |
| | 100.8 | 100.9 | 100.8 | 100.9 |

The soil removal results for Examples 2 and D containing short-chain nonionic surfactant were as follows:

| Soak/contact time | Soil removal (%) | | | |
|---|---|---|---|---|
| | Triolein | | Palmitic acid | |
| (minutes) | 2 | D | 2 | D |
| 5 | 36.2 | 22.2 | 49.6 | 47.3 |
| 10 | 50.7 | 26.3 | 60.1 | 50.7 |
| 15 | 58.7 | 26.9 | 60.7 | 50.0 |
| 20 | 60.8 | 28.5 | 63.6 | 54.7 |
| 30 | 63.8 | 26.1 | 63.5 | 55.6 |

Comparison of these results with those of Example 1 and Comparative Example A shows that both systems performed better in the presence of the highly efficient builder, sodium tripolyphosphate. However, the difference in performance between the microemulsion and the non-microemulsion was substantially increased, very high figures being obtained with the microemulsion. Also, palmitic acid removal was always better with the microemulsion system than with the comparative system.

The corresponding results for Comparative Examples E and F using longer-chain nonionic surfactant were as follows:

| Soak/contact time (minutes) | Soil removal (%) Triolein E | Triolein F | Palmitic acid E | Palmitic acid F |
|---|---|---|---|---|
| 5 | 7.5 | 20.8 | 46.5 | 37.1 |
| 10 | 12.3 | 26.0 | 51.6 | 42.0 |
| 15 | 17.7 | 31.1 | 51.7 | 44.8 |
| 20 | 22.9 | 33.1 | 54.8 | 49.0 |
| 30 | 39.5 | 34.8 | 55.9 | 53.8 |

On triolein, the microemulsion E gave significantly worse results than the microemulsion 2, and was also slow to reach the maximum value. Of the four systems only 2 gave really high values. The non-microemulsion systems D and F gave similar results, showing no benefit for the use of short-chain nonionic surfactant in the non-microemulsion system.

On palmitic acid, little difference was observed between the various systems.

| Example 3, Comparative Example G: EDTA builder | | |
|---|---|---|
| Example | 3 | G |
| Nonionic: | | |
| $C_{10}EO_4$[1] | 7.5 | 7.5 |
| $C_{9-11}EO_{2.5}$[2] | 2.5 | 2.5 |
| Hexadecane | 10.0 | — |
| EDTA[5] | 0.8 | 0.9 |
| Water (20° FH.) | 80.0 | 90.0 |
| | 100.8 | 100.9 |

Soil removal results were as follows:

| Soak/contact time (minutes) | Soil removal (%) Triolein 3 | Triolein G | Palmitic acid 3 | Palmitic acid G |
|---|---|---|---|---|
| 5 | 32.0 | 16.4 | 44.5 | 39.7 |
| 10 | 45.0 | 17.0 | 48.7 | 40.7 |
| 15 | 45.6 | 19.3 | 46.2 | 45.7 |
| 20 | 48.4 | 21.2 | 47.4 | 46.2 |
| 30 | 36.0 | 18.8 | 44.3 | 53.4 |

These results show a similar pattern to that seen with sodium tripolyphosphate builder, but the benefit was smaller. With palmitic acid, only a kinetic advantage was seen.

The following Examples show that much better detergency could be achieved using polymeric builders.

| Examples 4 and 5, Comparative Example H acrylate/maleate copolymer builder | | | |
|---|---|---|---|
| Example | 4 | H | 5 |
| Nonionic: | | | |
| $C_{10}EO_4$[1] | 7.5 | 7.5 | — |
| $C_{9-11}EO_{2.5}$[2] | 2.5 | 2.5 | — |
| $C_{12-14}EO_{4.4}$[3] | — | — | 10.0 |
| Hexadecane | 10.0 | — | 10.0 |
| AA/MA[6] | 0.8 | 0.9 | 0.8 |
| Water (20° FH.) | 80.0 | 90.0 | 80.0 |
| | 100.8 | 100.9 | 100.8 |

The soil removal results were as follows:

| | Triolein 4 | Triolein H | Triolein 5 | Palmitic acid 4 | Palmitic acid H | Palmitic acid 5 |
|---|---|---|---|---|---|---|
| 5 | 41.4 | 12.5 | 6.0 | 49.4 | 27.2 | 39.0 |
| 10 | 53.4 | 16.5 | 8.5 | 54.1 | 34.3 | 41.6 |
| 15 | 56.2 | 17.1 | 12.6 | 56.4 | 36.4 | 45.6 |
| 20 | 59.8 | 18.6 | 18.6 | 59.8 | 37.4 | 49.6 |
| 30 | 58.7 | 19.2 | 33.6 | 62.1 | 42.7 | 55.0 |

| Examples 6 and 7, Comparative Example J: poly(vinyl acetate/itaconate) builder | | | |
|---|---|---|---|
| Example | 6 | J | 7 |
| Nonionic: | | | |
| $C_{10}EO_4$[1] | 7.5 | 7.5 | — |
| $C_{9-11}EO_{2.5}$[2] | 2.5 | 2.5 | — |
| $C_{12-14}EO_{4.4}$[3] | — | — | 10.0 |
| Hexadecane | 10.0 | — | 10.0 |
| PVA/IA[7] | 0.8 | 0.9 | 0.8 |
| Water (20° FH.) | 80.0 | 90.0 | 80.0 |
| | 100.8 | 100.9 | 100.8 |

The soil removal results were as follows:

| | Triolein 6 | Triolein J | Triolein 7 | Palmitic acid 6 | Palmitic acid J | Palmitic acid 7 |
|---|---|---|---|---|---|---|
| 5 | 32.3 | 16.0 | 3.4 | 52.3 | 33.9 | 41.4 |
| 10 | 45.5 | 17.9 | 5.3 | 61.6 | 41.4 | 43.8 |
| 15 | 50.3 | 20.7 | 7.9 | 63.4 | 45.3 | 47.1 |
| 20 | 58.2 | 20.2 | 13.6 | 67.0 | 47.4 | 49.5 |
| 30 | 64.3 | 20.2 | 30.1 | 64.7 | 48.4 | 53.8 |

| Example 8: sodium citrate builder | |
|---|---|
| Example | 8 |
| Nonionic: | |
| $C_{10}EO_4$[1] | 7.5 |
| $C_{9-11}EO_{2.5}$[2] | 2.5 |
| Hexadecane | 10.0 |
| Sodium citrate | 0.8 |
| Water (20° FH.) | 80.0 |
| | 100.8 |

Soil removal results were as follows:

| Soak/contact time (minutes) | Soil removal (%) Triolein | Palmitic acid |
|---|---|---|
| 5 | 42.0 | 31.6 |
| 10 | 41.9 | 33.0 |
| 15 | 39.7 | 35.1 |
| 20 | 40.8 | 35.9 |
| 30 | 38.3 | 38.9 |

These results, when compared with earlier Examples, show some benefit over an unbuilt system, but demonstrate citrate to be a very much less effective builder in these systems than are sodium tripolyphosphate or polymeric builders.

We claim:

1. A fabric washing detergent composition comprising:

(i) from 5 to 25 wt. % of an organic surfactant system comprising:

(a) 50–100 wt. % of ethoxylated alcohol nonionic surfactant having an average alkyl chain length of less than $C_{12}$ and a content of $C_{10}$ material (based on the alcohol) of at least 45 wt. %;

(b) optionally up to 50 wt. % of co-surfactant other than ethoxylated alcohol nonionic surfactant, (ii) from 0.5 to 55 wt. % of $C_{12-16}$ alkane solvent, (iii) from 0.2 to 3 wt. % of water-soluble detergency builder, selected from the group consisting of sodium tripolyphosphate, acrylate/maleate copolymers and poly(vinylacetate/itaconate) copolymers, (iv) water and optional minor ingredients to 100 wt. %, wherein the surfactant system (i) and the $C_{12-16}$ alkane solvent (ii) together with water form a stable oil-in-water microemulsion.

2. A detergent composition as claimed in claim 1, wherein the nonionic surfactant (i)(a) contains at least 70 wt % (based on the alcohol) of $C_{10}$ material.

3. A detergent composition as claimed in claim 1, wherein the nonionic surfactant (i)(a) contains at least 60 wt % (based on the alcohol) of material having a chain length of $C_{10}$ or less.

4. A detergent composition as claimed in claim 3, wherein the nonionic surfactant (i)(a) contains at least 75 wt % (based on the alcohol) of material having a chain length of $C_{10}$ or less.

5. A detergent composition as claimed in claim 1, wherein the solvent (ii) comprises hexadecane.

6. A detergent composition as claimed in claim 5, wherein the hexadecane (ii) is present in an amount of from 0.5 to 20 wt %.

7. A detergent composition as claimed in claim 5, wherein the weight ratio of hexadecane (ii) to nonionic surfactant (i)(a) is within the range of from 0.5:1 to 2:1.

8. A detergent composition as claimed in claim 1, wherein the organic surfactant system (i) contains less than 40 wt % of anionic surfactant.

* * * * *